US005718430A

United States Patent [19]

Aramapakul et al.

[11] Patent Number: 5,718,430

[45] Date of Patent: Feb. 17, 1998

[54] METHOD OF PLAYING A CARD GAME

[76] Inventors: Paiboon Aramapakul; Susan Travis, both of 2708 E. 15th. St., Long Beach, Calif. 90804

[21] Appl. No.: 595,953

[22] Filed: Feb. 6, 1996

Related U.S. Application Data

[63] Continuation of Ser. No. 377,198, Jan. 24, 1995, abandoned.

[51] Int. Cl.[6] ..... A63F 1/00

[52] U.S. Cl. ..... 273/292; 273/274

[58] Field of Search ..... 273/292, 274, 273/369, 85 CP, 309; 463/13, 12

[56] References Cited

U.S. PATENT DOCUMENTS 4,948,134 8/1990 Suttle et al. ..... 273/85 CP 5,382,025 1/1995 Sklansky et al. ..... 273/292

5,489,101 2/1996 Moody ..... 273/292

OTHER PUBLICATIONS

"Hold'em", Scarne's Encyclopedia Of Games, by John Scarne, Harper & Row Publishers, pp. 14 and 26, Dec. 1973.

*Primary Examiner*—Benjamin H. Layno

*Attorney, Agent, or Firm*—Lawrence S. Cohen

[57] ABSTRACT

A poker type cards game. First, each player bets. Then three cards are dealt face down to each player. Each player discards one card, keeping two. Then five cards are dealt face up as common cards. Each player makes a five card poker hand from any combination of his two hole cards and the common cards. Alternatives require that one only, or one or two of the hole cards be used.

6 Claims, 2 Drawing Sheets

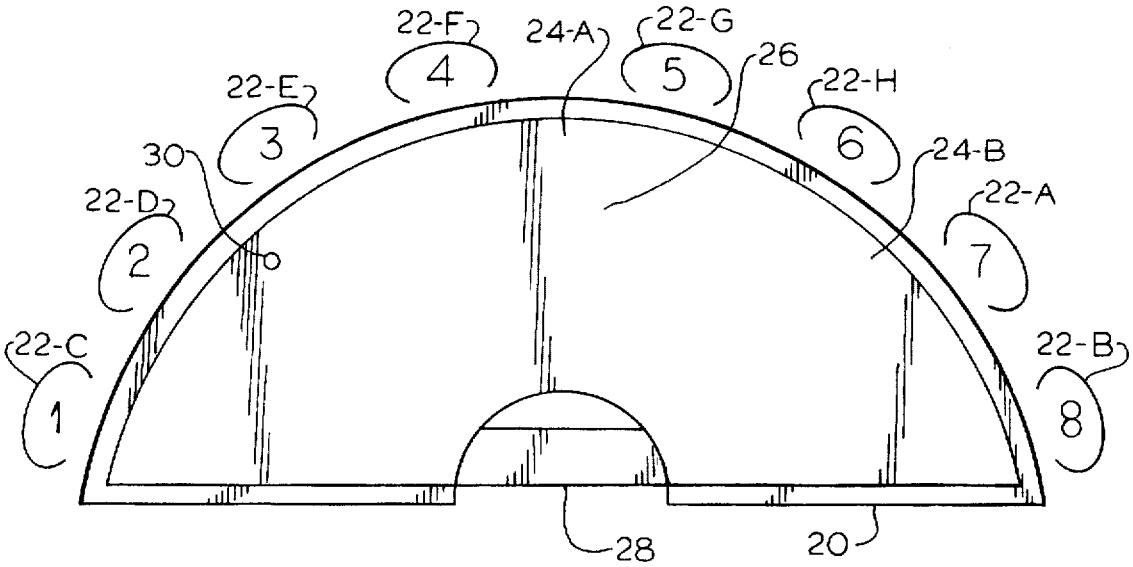
FIG. 1
FIG. 2
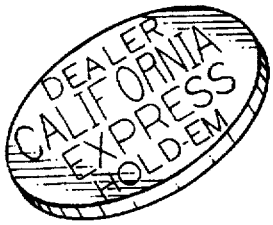

METHOD OF PLAYING A CARD GAME

REFERENCE TO RELATED APPLICATIONS

This is a continuation of application Ser. No. 08/377198 filed on Jan. 24, 1995, now abandoned, the contents of which are incorporated herein.

BACKGROUND ART

This invention relates to a method of playing a wagering-type card game using poker-hand priority, played on a game board table, involving players, wagering areas, and the usage of dealer cards.

Numerous types of prior art regarding card games used in gaming casinos consist of difficult rules that require specific knowledge to follow, thus, these prior games only confuse the players and/or players become bored and look for other games to play. This applies to many games of related pokers.

The new game called CALIFORNIA EXPRESS HOLD-EM, is an exciting and new approach to playing a game of speed over prior games, in the related field of pokers. This is not a slow game of check, bet, and raise, as in other games. This is a game of intense speed in which the hands are dealt rapidly and winners, win very quickly to increase the interest of all players.

SUMMARY OF THE INVENTION

The first advantage of the present invention, is to provide a card game with simple rules to follow. This will benefit many persons who have a hard time comprehending difficult game rules. Unlike other wagering card games, this is not a game of Texas Hold-em. This is a variation of Hold-em.

(a) The object of the present invention, has a distinction all of its own. This game is played by a predetermined set of simple rules and upon a board card selection to form a speed-type poker hand. In one embodiment the game, using standard poker hand priority begins with a wagering round. Then three cards are dealt to each player. Each player discards one of the three cards. Then, five common cards are dealt face up. Each player's hand is set by selecting the best five cards of the seven consisting of two hole cards and the five common cards. Wagers are then resolved.

(b) Another object of the present invention is to provide a table that includes eight or additional player stations, side-betting pools, plus a non-playing dealer.

(c) Another object of the present invention is to provide a game wherein, the dealer only deals cards directly to the players. Also, the dealer offers all seated players a choice of becoming player-bank, which is selected and rotates in a clockwise direction.

(d) A further object of the present invention is to provide a card game allowing all players a plurality of wagering, before the cards are dealt. In one wagering process the next dealer proceeds with the dealing of the cards to only seated players, the three cards face down.

(e) In an alternative embodiment, all players are required to discard one card in hand and play with both two remaining cards in hand in addition to the utilization of three of the five board cards that are offered to the players and player-bank to form a final winning poker hand. That is, the five card poker hand must use the two hole cards. In further alternative, each player may use either one or both of the hole cards and four or three of the common cards to form the five card hand.

(f) A further object of the present invention is that once the player-bank position has been established, upon agreement between the dealer and player, the player must only wager and individually play against the player-bank and players are not entitled to play against one, another.

(g) A further object of the present invention is that the present game operates with extreme, fast action, thus, hands are dealt more frequently, resulting in more profit for the card clubs and players win hands much faster than previous poker style games. Also, this game holds possible job creation in the future by clubs adding card dealers. Game can be adapted for machine use, jackpot and extra players may be added also without changing the game structure.

(h) According to a further object, a player may surrender the hand after seeing the three hole cards and may either (i) obtain return of his wager or (ii) sacrifice his wager and (iii) play the next hand free of house collection or (iv) loose his house collection but obtain the return of his wager.

BRIEF DESCRIPTION OF THE DRAWINGS

In the drawings, closely related figures have the same number but different suffixes.

FIG. 1 shows an overall, top view of a game table used to practice a game playing method in accordance with the present invention. Also a seating arrangement of players, dealers position, side-betting pools, and card playing area, also a button with indica used in reference to the game.

FIG. 2 shows an enlarged, side view of a disk-shaped button that indicates and is associated with dealer positioning to represent the player-bank position. The indica relates to the game.

| | |
|---|---|
| 20-table | 34-player-bank cards |
| 22-A-H-players seated | 36-wager area |
| 24-A-B-side-betting pools | 38-A-H-seated player dealt cards |
| 26-playing area | 40-collection box |
| 28-dealer | 42-dealers chips |
| 30-button with indica | 44-remainder of dealt cards |
| 32-five board card selection | |

Figure 4:
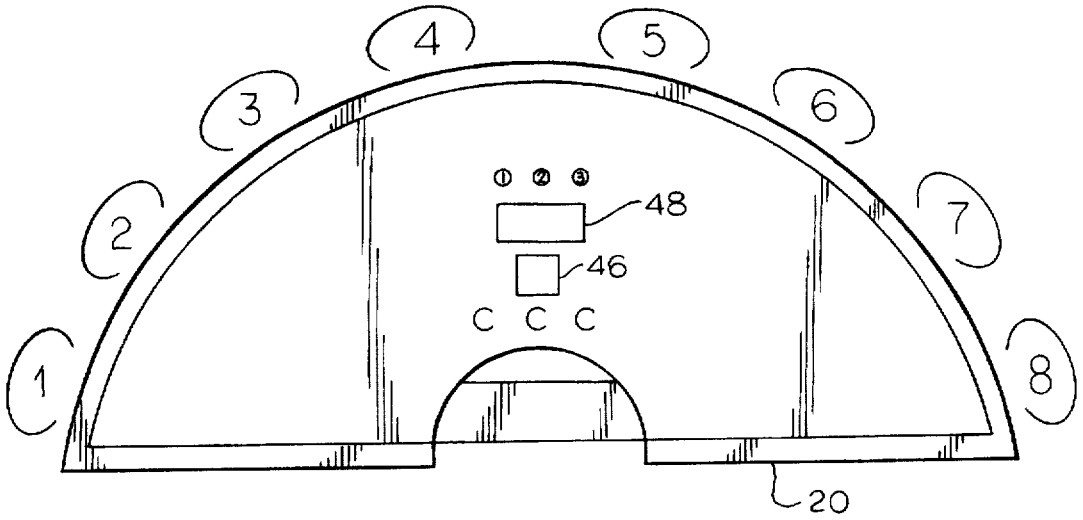

FIG. 4 shows an partial alternative table layout.

MODES FOR CARRYING OUT THE INVENTION

Figure 3:
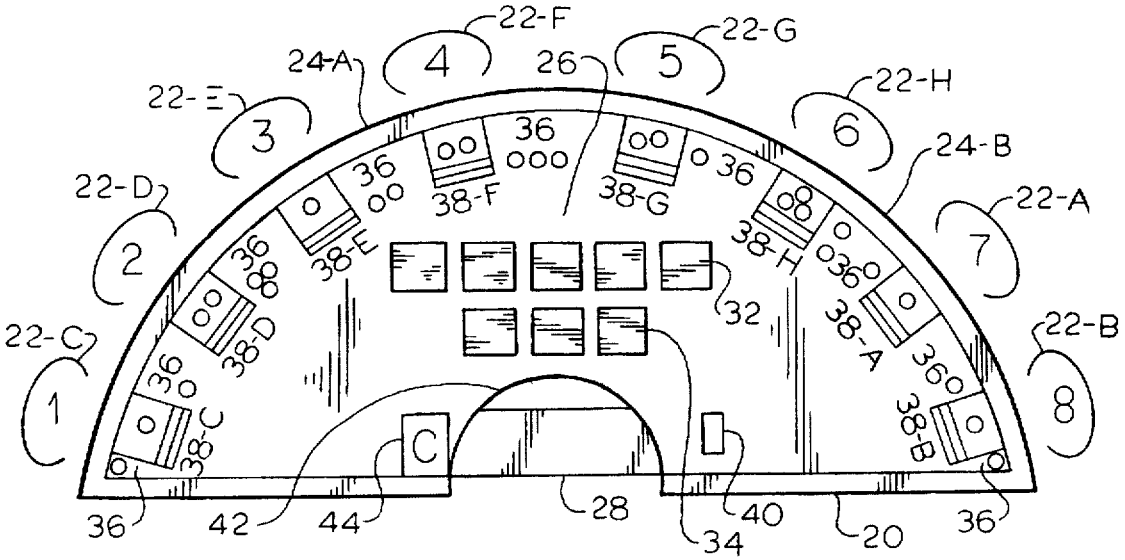
FIG. 3 shows an extensive, top view of the table with complete accuracy of the invention. Reference numerals, some with different alphabetic suffixes are listed below.

A typical embodiment of the present invention is in FIGS. 1 and 3, a plan top view of the game table 20 with a description of the preferred embodiment in accordance with the present invention; a method of playing a wagering game. The table 20, designates the successive arrangement of the seated game players 22-A through 22-H. These players are seated in a clockwise position for the allowance of their access to the wagering area 36. The wagering area 36 is located on table 20 and superior to the seated players 22-A–H. The order of the positioning is left to the players own judgement, but the seating of the players 22-A–H is established in the advance of the game. Referring to the two designated points marked 24-A and 24-B, these are considered as side-betting pools, where unseated persons may pool bets or wagers with the seated players 22-A–H, to add and increase the wagered amounts. This is allowed in most wagering games of rotation. The center of table 20 includes a playing area 26, in which the card dealer 28, utilizes for cards dealt, discards, and wagering exchanges. Arranged players in a successive order determines the progressive action in games where one player at a time can choose to become what is called player-bank, in which position is only offered by the dealer 28, and agreed upon by the seated players 22-A–H. The seated players 22-A–H, have the option to except the player-bank position or pass the option on to the next player rotating clockwise. An example is if 22-D refuses, then the option is offered to 22-E who in turn agrees to hold the player-bank position, thus player 22-E is established as player-bank. His or her acceptance will display that placement by a button 30, and positioned by dealer 28. Also, on table 20, is a five board selection 32, in which players 22-A–H, use to form a poker hand along with the previously dealt cards 38-A–H.

FIG. 2 shows a circular button displayed with indica and designates the player-bank position. Also used to illustrate a symbol in association with the present invention.

FIG. 3 shows a concise and accurate view of the entire set-up of the invention along with reference numerals, some of which have different alphabetic suffixes that are indicative of the function of the invention.

FIG. 4 shows another table layout.

SUMMARY AND PLAY OF THE INVENTION

The game is quickly and easily played by one standard deck of fifty-two cards. A jackpot may be added, also extra players may be added for increased action, but not necessarily because the action is contained in the speed and the structure of the game which proves to be fast-paced and very exciting. The house or casino furnishes the table, card dealer, the house dealer does not play. The functions of the dealer are to determine proper wagers, deal cards, take up all house portion of wagers, declare winners and pay off the wagers of the winners. Also, dealers must keep track of the side-bets by using the wagering areas as designated.

GENERAL CATEGORIES OF THE HANDS IN DESCENDING ORDER OF VALUE (these are normal poker hand priorities)

1. Royal Flush
2. Straight Flush
3. Four of a Kind
4. Full House
5. Flush
6. Straight
7. Three of a Kind
8. Two Pair
9. One Pair

JACKPOT HANDS IN RANK OF DESCENDING VALUE

1. Royal Flush
2. Straight Flush
3. Four of a Kind

CARD CLUB REGULATIONS

1. There is no wager limitation on the player-bank.
2. Each player has the option of designated player-bank for two consecutive hands, in turn
3. All seated players, play in a clockwise direction, starting with the designated button used for the player-bank.
4. The contents of each hand must be kept secret during the play of the hand.
5. All cash will be changed to chips and all wagers will be paid off with chips by the dealer.
6. It is the players responsibility to set his or her hand.
7. No wagers can be moved until all hands are open.
8. Ties are a push, and have no effect on the settlement of other wagers.
9. All seated players play only against the player-bank, and not against one another.
10. Cards removed from the table may be declared dead cards.
11. You may place a plurality of chip wagers on each hand.
12. A mis-deal will be declared, if two or more cards are exposed on the deal.
13. Declared winners are paid off in even money by the dealer.
14. It is the dealers responsibility to deal cards, collect wagers, declare winner, and pay off all winnings.

The object of the game is to create a five card poker hand for all seated players. The player wins with the highest ranked poker hand, and must have a higher ranking poker hand than that of the player-bank. That is, in case of a tie, the player-bank wins. All players must play against the player-bank. Speed has been implemented into the game to increase interest and provide new entertainment for all players. Since the game is so fastly played, the casino will benefit profitwise also by the amount of collection that is taken up before each hand is dealt. Players will also play, and win very rapidly. Many players may win at a time, as long as they have cards ranking higher than the player-bank.

Following are examples of typical play. In all cases the player-bank, order of dealing, selection of first action are chosen in conventional fashion. A bet is made by each player, the player-bank, as is customary, establishing the bank limit.

The players bet before they see their hole cards, this is best done before the cards are dealt. Three cards (the hole cards) are dealt to each player including the player-bank. Then each player looks at his three cards and selects one to discard (face down). Then five cards are dealt face up on the table (a five card flop). These are community or common cards and are used by all participants. Each player then combines the five community cards with his two hole cards to make the best possible five card poker hand of the seven cards. Any combination of the seven cards can be used. In alternative play, the player must use both his hole cards plus three of the common cards; or one or both of the hole cards and four or three of the common cards.

Starting with the first action player, each player's hand is compared with the player bank hand to determine a win or loss. In order to win a player's selected hand must rank higher than the player-bank's hand using conventional poker hand rankings.

As is conventional in player-bank play, wins and losses will be distributed and taken out of the player-bank's bank until the bank is depleted. A player who receives no action due to depletion of the bank is usually given a free collection on the next hand. In the event of a tie between the player-bank and a player it is usual that the bank hand wins.

Jackpot play is also possible. In continued jackpot play, at least two players must have qualifying hands. If a jackpot is offered it is hit by a player having a hand of four of a kind or better, with all qualifying hands utilizing both hole cards. The lower of the two best wins the jackpot. Or if there are more than two qualified hands the second best wins.

In a "houseway" alternative, a player-bank can ask the casino dealer which cards he should select to make his five card hand. In such case the dealer will use a standard priority.

The game can be played without a player-bank. In such case, each player places an equal wager. The wagers are collected by the dealer. Play proceeds and the highest ranking poker hand wins the pot. In case of a tie the pot is split among the tied hands.

A surrender alternative can be employed. In this play, any player except a player-bank can surrender his hand before the five card flop is dealt. Usually this means he can play the next hand without a collection, but his bet is lost.

FIG. 4 shows portion of a table set up for the player area. The circles marked 1, 2 and 3 indicate that three (or more) wagers can be made for the hand. This can be done by the player or by others. The rectangle 48 shows where the hole cards are placed and rectangle 46 where the discard goes.

Although particular embodiments of the invention have been described and illustrated herein, it is recognized that modifications and variations may readily occur to those skilled in the art, and consequently it is intended that the claims be interpreted to cover such modifications and equivalents.

We claim:

1. A method of playing a poker game, in which one player is selected as a player-bank comprising the steps of;

the player-banker wagering a desired amount designated as the bank amount;

the other players wagering desired amounts each;

dealing three hole cards to each player;

each player discarding one of the three hole cards;

dealing five cards face up as common cards;

each player in turn, from a predetermined first player resolving his wager with the player-bank based on poker hand priority by selecting the best five card hand of the seven cards consisting of the player's two hole cards and the five common cards; and wherein a higher hand wins over the player-bank and otherwise the player-bank wins.

2. The method of claim 1 wherein the five card hand of each player must use both hole cards of that play.

3. A method of playing a poker game in which the players play against each other for a single winner comprising the steps of:

each player wagers an equal predetermined amount dealing three hole cards to each player;

each player discarding one of the three hole cards;

dealing five cards face up as common cards;

each player setting a five card poker hand from any combination of the seven cards consisting of the two hole cards and the five common cards;

and resolving wagers by poker hand priority rules.

4. The method of claim 3 wherein the five card hand of each player must use both hole cards of that play.

5. A method of playing a poker game comprising;

each player wagering;

dealing three hole cards to each player;

each player discarding one of the three hole cards;

dealing five cards face up as common cards;

each player setting a five card hand from any combination of the seven cards consisting of the two remaining hole cards and the five common cards; and resolving wagers by poker hand priority rules.

6. The method of claim 5 wherein the five card hand of each player must use both hole cards of that play.

* * * * *